United States Patent [19]

Okano et al.

[11] 4,383,799

[45] May 17, 1983

[54] RING AND GROOVE CONTRACTION FOR ASSEMBLING A TURBOCHARGER

[75] Inventors: Hiroshi Okano, Mishima; Yoshihisa Gunji, Susono, both of Japan

[73] Assignee: Toyota Iidosha Kogyo Kabushiki Kaisha, Toyota, Japan

[21] Appl. No.: 165,932

[22] Filed: Jul. 2, 1980

[30] Foreign Application Priority Data

Apr. 7, 1980 [JP] Japan ..... 55-44703

[51] Int. Cl.[3] ..... F04D 29/40

[52] U.S. Cl. ..... 415/219 C; 403/326; 403/DIG. 6

[58] Field of Search ..... 417/407; 403/326, DIG. 6; 415/219 C, 219 A; 285/321

[56] References Cited

U.S. PATENT DOCUMENTS

| | | | |
|---|---|---|---|
| 2,703,674 | 3/1955 | Wood | 417/407 X |
| 2,748,715 | 6/1956 | Mamo | 415/219 C |
| 2,784,675 | 3/1957 | Farrell | 415/219 C X |
| 3,063,742 | 11/1962 | Howard | 285/321 |
| 3,138,107 | 6/1964 | Zeidler | 415/219 C |
| 3,411,706 | 11/1968 | Woollenweber, Jr. et al. | 417/407 |
| 3,600,895 | 8/1971 | Suter | 285/321 X |
| 3,861,820 | 1/1975 | Hornschurch | 415/219 C X |
| 3,874,814 | 4/1975 | Carroll et al. | 415/219 C |
| 4,087,120 | 5/1978 | Rumble | 285/321 X |

FOREIGN PATENT DOCUMENTS

| | | | |
|---|---|---|---|
| 1249028 | 8/1967 | Fed. Rep. of Germany | 285/321 |
| 1453515 | 3/1969 | Fed. Rep. of Germany | 91/491 |

*Primary Examiner*—Leonard E. Smith

*Attorney, Agent, or Firm*—Stevens, Davis, Miller & Mosher

[57] ABSTRACT

A turbocharger comprising a center housing and a compressor housing. The compressor housing is fixed onto the center housing in such a way that the cylindrical inner wall of the compressor housing is fitted onto the cylindrical outer wall of the center housing. A single ring groove is formed on the cylindrical inner wall of the compressor housing. A snap ring and an O ring are fitted into the single ring groove for fixing the compressor housing onto the center housing while sealing therebetween.

6 Claims, 8 Drawing Figures

Fig. 2
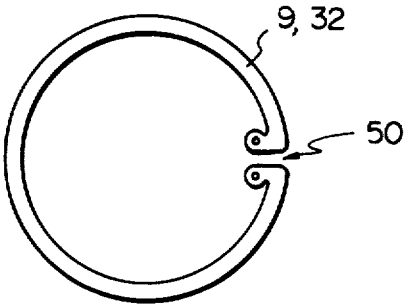
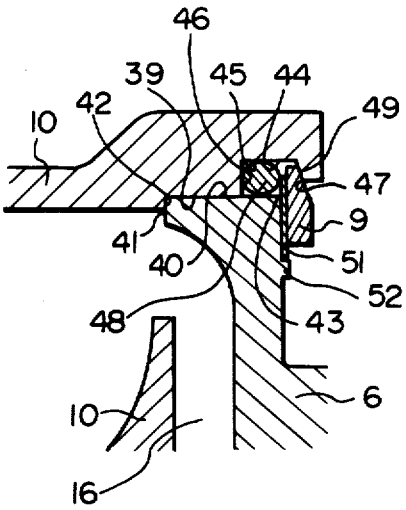
Fig. 3
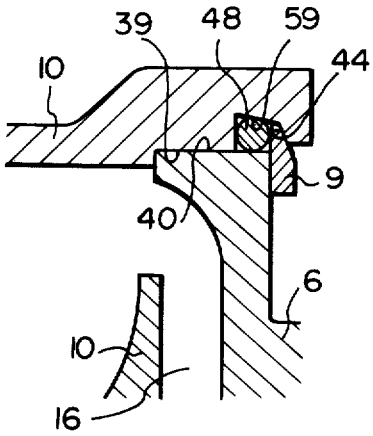
Fig. 4

RING AND GROOVE CONTRACTION FOR ASSEMBLING A TURBOCHARGER

DESCRIPTION OF THE INVENTION

The present invention relates to a turbocharger for use in an internal combustion engine.

In a turbocharger, as a method of fixing, for example, the compressor housing onto the center housing while sealing therebetween, a method is considered in which the cylindrical outer wall of the center housing is fitted into the cylindrical inner wall of the compressor housing. A snap ring groove is formed on the cylindrical inner wall of the compressor housing at a position on the circumference of the end portion of the cylindrical outer wall of the center housing so that the compressor housing is fixed onto the center housing by a snap ring which is fitted into the snap ring groove. In addition, an O ring groove is formed on the cylindrical inner wall of the compressor housing at a position adjacent to the snap ring groove so that the contact surfaces of the cylindrical inner wall of the compressor housing and the cylindrical outer wall of the center housing are sealed by an O ring which is fitted into the O ring groove. However, in this method, since it is necessary to form both the snap ring groove and the O ring groove, each having a narrow width and arranged adjacent to each other, on the cylindrical inner wall of the compressor housing, a problem occurs in that the production of the grooves is complicated and, furthermore, it takes a long time to form the grooves.

An object of the present invention is to provide a turbocharger in which a snap ring groove and an O ring groove can be easily formed. According to the present invention, there is provided a turbocharger comprising: a first member having an axially extending cylindrical outer wall, a first end face and a second end face opposite to the first end face; a second member having an axially extending cylindrical inner wall which is fitted onto the cylindrical outer wall of the first member; stop means cooperating with the first end face of the first member for restricting the axial movement of the first member; a snap ring cooperating with both the second end face of the first member and the cylindrical inner wall of the second member for restricting the axial movement of said first member, and; an O ring arranged between the cylindrical outer wall of the first member and the cylindrical inner wall of the second member, wherein the cylindrical inner wall of the second member has a single ring groove formed thereon on the circumference of the second end face of the first member and extending in opposite axial directions from the second end face of the first member, the snap ring having an inner circumferential portion and an outer circumferential portion which is in engagement with the ring groove, the inner circumferential portion of the snap ring being in engagement with the second end face of the first member, the O ring being inserted into the ring groove around the cylindrical outer wall of the first member.

The present invention may be more fully understood from the description of preferred embodiments of the invention set forth below, together with the accompanying drawings.

BRIEF DESCRIPTION OF THE DRAWINGS

In the drawings:

FIG. 2 is a plan view of a snap ring;

FIG. 3 is an enlarged cross-sectional side view, illustrating the portion enclosed by the circle A in FIG. 1;

FIG. 4 is an enlarged cross-sectional side view of another embodiment of FIG. 3 according to the present invention;

DESCRIPTION OF PREFERRED EMBODIMENTS

Figure 1:
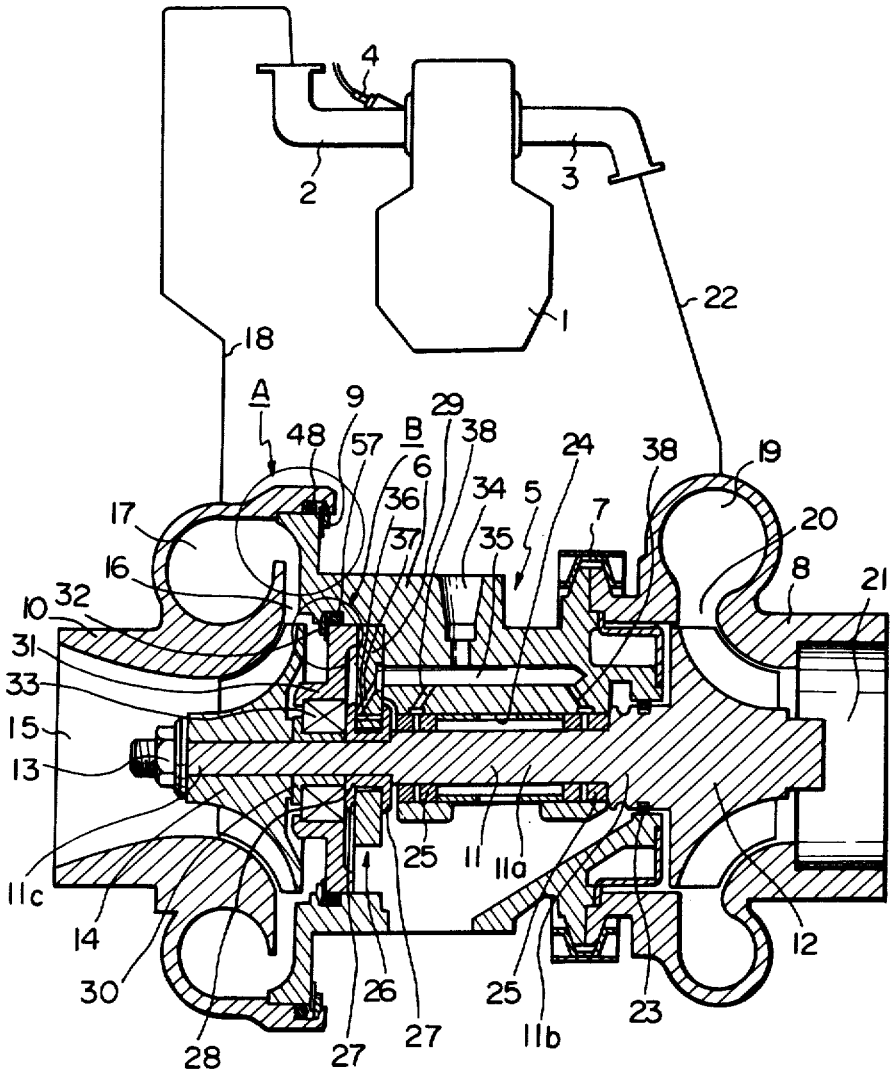
FIG. 1 is a cross-sectional side view of an embodiment of a turbocharger according to the present invention.

Referring to FIG. 1, 1 designates an engine body, 2 an intake manifold, 3 an exhaust manifold, 4 a fuel injector, and 5 a turbocharger. The turbocharger 5 comprises a center housing 6, a turbine housing 8 secured onto one end of the center housing 6 by a band 7, a compressor housing 10 secured onto the other end of the center housing 6 by a snap ring 9, a rotary shaft 11 rotatably inserted into the inside of the center housing 6, a turbine wheel 12 formed in one piece on one end of the rotary shaft 11, and an impeller 14 fixed onto the other end of the rotary shaft 11 by a nut 13. An air inlet 15, a vaneless diffuser 16 and a scroll shaped air discharge chamber 17 are formed in the compressor housing 10, and the air discharge chamber 17 is connected to the intake manifold 2 via an air duct 18. The turbine housing 8 has a scroll shaped exhaust gas inflow chamber 19, a turbine nozzle 20 and an exhaust gas outlet 21 therein, and the exhaust gas inflow chamber 19 is connected to the exhaust manifold 3 via an exhaust duct 22. When the engine is operating, the compressed air within the air discharge chamber 17, which is compressed by the rotating motion of the impeller 14, is fed into the intake manifold 2 via the air duct 18. Then, fuel is injected from the fuel injector 4 into the air which is fed into the intake manifold 2 and, thus, a mixture is formed within the intake manifold 2. After this, the mixture thus formed is fed into the cylinders of the engine body 1. The exhaust gas, discharged from the cylinders of the engine body 1 into the exhaust manifold 3, is fed into the exhaust gas inflow chamber 19 via the exhaust duct 22. The exhaust gas, fed into the exhaust gas inflow chamber 19, is injected from the turbine nozzle 20 to provide the rotating force for the turbine wheel 12 and, then, the exhaust gas is discharged from the exhaust gas outlet 21.

As illustrated in FIG. 1, the rotary shaft 11 comprises a central portion 11*a*, an increased diameter portion 11*b* and a reduced diameter portion 11*c*. A piston ring 23 for sealing is inserted between the center housing 6 and the increased diameter portion 11*b* of the rotary shaft 11. In addition, a pair of spaced floating radial bearings 25 are arranged within a cylindrical bore 24 which is formed within the central housing 6. The rotary shaft 11 is rotatably supported by a pair of the floating radial bearings 25. In order to axially support the rotary shaft 11, a thrust bearing 26 is arranged on the reduced diameter portion 11c of the rotary shaft 11. The thrust bearing 26 comprises a runner member 28 having a pair of disc shaped runners 27 thereon, and a stationary bearing plate 29 arranged between the runners 27 and slightly spaced from the runners 27. The runner member 28 is fixed onto the reduced diameter portion 11c of the rotary shaft 11 via a spacer 30 and the impeller 14 by the nut 13, and the stationary bearing plate 29 is fixed onto the center housing 6 via a partition member 31 by a snap ring 32. In addition, a seal 33, which is constructed in the form of a mechanical seal, is arranged between the partition member 31 and the spacer 30. A lubricating oil inlet port 34 and a lubricating oil distribution hole 35 are formed in the center housing 6, and the lubricating oil inlet port 34 is connected to the lubricating oil feed pump (not shown). A lubricating oil outflow bore 36, extending in parallel to the axis of the rotary shaft 11, is formed in the stationary bearing plate 29. This lubricating oil outflow bore 36 is connected to the lubricating oil distribution hole 35 via a lubricating oil bore 37. The lubricating oil is fed into the lubricating oil distribution hole 35 from the lubricating oil inlet port 34 and then fed into the lubricating oil outflow bore 36 via the lubricating oil bore 37. After this, the lubricating oil flows into the clearances between the stationary bearing plate 29 and the runners 27 and, thus, the lubricating operation of the thrust bearing 26 is carried out. A pair of lubricating oil feed bores 38, each extending from the lubricating oil distribution hole 35 towards the corresponding floating radial bearings 25, is formed in the center housing 6, and the lubricating operation of the floating radial bearings 25 is carried out by the lubricating oil flowing out from the lubricating oil feed bores 38.

Figure 6:
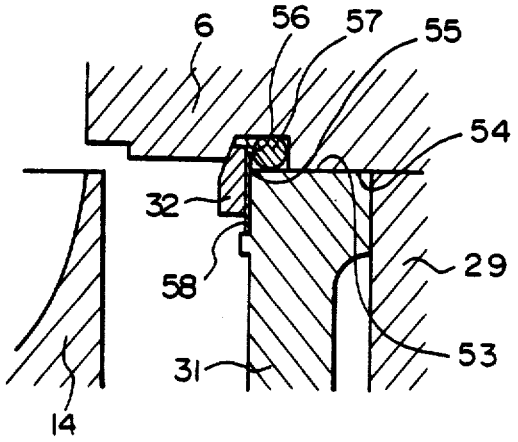
FIG. 6 is an enlarged cross-sectional side view illustrating the portion enclosed by the circle B in FIG. 1.

FIG. 3 illustrates an enlarged cross-sectional side view of the portion enclosed by the circle A in FIG. 1, and FIG. 6 illustrates an enlarged cross-sectional side view of the portion enclosed by the circle B in FIG. 1. Referring to FIGS. 1 and 3, a cylindrical inner wall 39 of the compressor housing 10 is fitted onto a cylindrical outer wall 40 of the center housing 6. In addition, the center housing 6 is positioned in a position in such a way that an end face 41 of the center housing 6 abuts against a step portion 42 which projects inwardly from the inner end of the cylindrical inner wall 39 of the compressor housing 10. A ring groove 44, axially extending towards both the left and the right in FIG. 3 from an edge 43 of the center housing 6, is formed on the cylindrical inner wall 39 of the compressor housing 10 at a position on the circumference of the edge 43 of the center housing 6. As illustrated in FIG. 3, the ring groove 44 comprises a cylindrical bottom wall 45, a substantially vertically extending annular side wall 46, and a tapered annular side wall 47 arranged to face the annular side wall 46. An O ring 48 and the outer circumferential portion of the snap ring 9 are fitted into the ring groove 44. The outer circumferential portion of the snap ring 9 has a tapered side wall 49, and the snap ring 9 has a split 50 (FIG. 2). When the snap ring 9 is fitted into the ring groove 44, the tapered side wall 49 of the snap ring 9 abuts against the tapered annular side wall 47 of the ring groove 44 and, thereby, the compressor housing 10 is fixed onto the center housing 6. As illustrated in FIG. 2, the snap ring 9 has the split 50 and, therefore, if the O ring 48 (FIG. 3) is arranged to directly contact with the snap ring 9, there is a problem in that a portion of the O ring 48 may protrude from the split 50 of the snap ring 9. In order to avoid such a problem, as illustrated in FIG. 3, a ring shaped spacer 51 is inserted between the snap ring 9 and the side wall of the center housing 9. The circumferential outer portion of the spacer 51 projects into the ring groove 44 and supports the O ring 48, and the inner end of the spacer 51 abuts against a projection 52 formed in one piece on the side wall of the center housing 6. The positioning of the spacer 51 is determined by the projection 52.

Referring to FIG. 6, a cylindrical outer wall 53 of the partition member 31 is fitted into a cylindrical inner wall 54 of the center housing 6. A ring groove 56, axially extending towards both the left and the right in FIG. 6 from an edge 55 of the cylindrical outer wall 53 of the partition member 31, is formed on the cylindrical inner wall 54 of the center housing 6 at a position on the circumference of the edge 55 of the partition member 31. In the same manner as is illustrated in FIG. 3, an O ring 57 and the outer circumferential portion of the snap ring 32 are fitted into the ring groove 56 and, in addition, a ring shaped spacer 58 is inserted between the snap ring 32 and the end face of the partition member 31.

Figure 7:
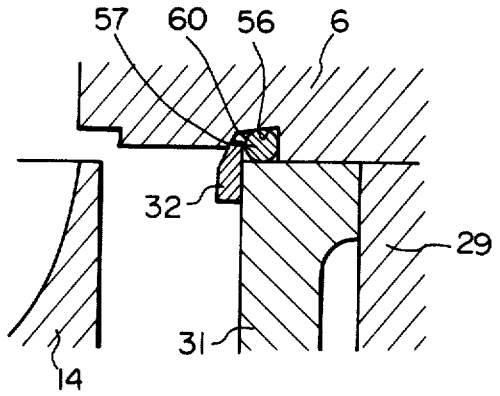
FIG. 7 is an enlarged cross-sectional side view of another embodiment of FIG. 6 according to the present invention.

FIGS. 4 and 7 each illustrate another embodiment of FIGS. 3 and 6, respectively. Referring to FIGS. 4 and 7, the ring grooves 44 and 56 have tapered bottom walls 59 and 60 which are so formed that the depths of the ring grooves 44 and 56 are gradually reduced towards the snap rings 9 and 32, respectively. Therefore, since the axial movement of the O rings 48 and 57 is restricted by the tapered bottom walls 59 and 60, respectively, there is no possibility that portions of the O rings 48 and 57 protrude from the split 50 (FIG. 2) of each of the snap rings 9 and 32.

Figure 5:
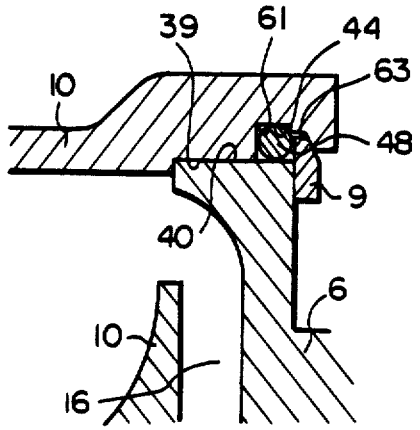
FIG. 5 is an enlarged cross-sectional side view of a further embodiment of FIG. 3 according to the present invention.
Figure 8:
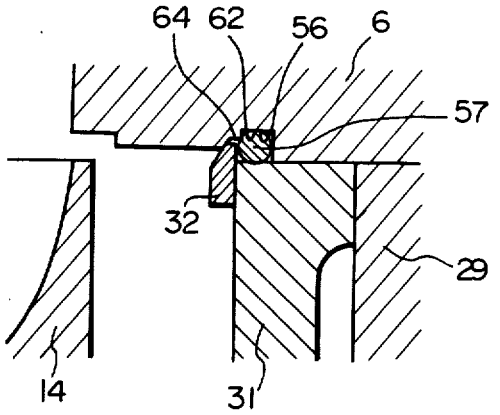
FIG. 8 is an enlarged cross-sectional side view of a further embodiment of FIG. 6 according to the present invention.

FIGS. 5 and 8 illustrate further embodiments of FIGS. 3 and 6, respectively. Referring to FIGS. 5 and 8, annular projections 63 and 64, projecting towards the snap rings 9 and 32, are formed in one piece on cylindrical bottom walls 61 and 62 of the ring grooves 44 and 56, respectively. Therefore, since the axial movement of the O rings 48 and 57 is restricted by the annular projections 63 and 64, respectively, there is no possibility that portions of the O rings 48 and 57 protrude from the split 50 (FIG. 2) of each of the snap rings 9 and 32.

According to the present invention, only a single ring groove is provided for a snap ring and an O ring. Therefore, the number of ring grooves is reduced as compared with that of the prior art and, in addition, the width of a ring groove is widened as compared with that of the prior art. As a result of this, a ring groove can be easily formed by machine.

While the invention has been described by reference to specific embodiments chosen for purposes of illustration, it should be apparent that numerous modifications could be made thereto by those skilled in the art without departing from the spirit and scope of the invention.

We claim:

1. A turbocharger comprising: a first member having an axially extending cylindrical outer wall, a first end face and a second end face opposite to the first end face; a second member having an axially extending cylindrical inner wall which is fitted onto the cylindrical outer wall of the first member; stop means cooperating with the first end face of the first member for restricting the axial movement of the first member; a snap ring cooperating with both the second end face of the first member and the cylindrical inner wall of the second member for restricting the axial movement of said first member; an O ring arranged between the cylindrical outer wall of the first member and the cylindrical inner wall of the second member; and a ring shaped spacer inserted between the snap ring and the second end face of the first member, wherein the cylindrical inner wall of the second member comprises a single ring groove formed thereon on the circumference of the second end face of the first member and extending in opposite axial directions from the second end face of the first member, the ring groove having a tapered side wall extending half way into the radially outermost depths of said ring groove, the snap ring having an inner circumferential portion and an outer circumferential portion having a tapered side wall which is in engagement with the tapered side wall of the ring groove, the second end face of the first member having a ring shaped projection at a position inside of the ring-shaped spacer, the ring shaped spacer having an inner end which is in engagement with the projection, the ring shaped spacer having an outer circumferential portion projecting into the ring groove so that the edge of said outer circumferential portion terminates at the same depth within the ring groove as the tapered side wall of the ring groove, and the O ring being inserted into the ring groove around the cylindrical outer wall of the first member.

2. A turbocharger as claimed in claim 1, wherein the ring groove has a cylindrical bottom wall.

3. A ring and groove construction adapted for use in a turbocharger of an internal combustion engine in which a first member is removably secured to a second member by said ring and groove construction, said first member having an axially extending cylindrical inner wall, said second member having an outer cylindrical wall over which said cylindrical inner wall of said first member slidably engages, said first member having a first abutment integrally formed thereon, said second member having first and second faces axially spaced on opposite sides of said outer cylindrical wall, said first face abutting said first abutment so as to restrict axial movement of said first member, said ring and groove construction comprising:

a ring groove located in said first member comprising first and second sidewalls and an axially extending inner surface extending therebetween which is spaced radially outwardly from said outer cylindrical wall of said second housing when said outer cylindrical wall is positioned within said cylindrical inner wall, said second sidewall being tapered and extending half-way into the radially outermost depths of said ring groove;

an O ring positioned within said ring groove and in contacting engagement with both said first and second members to provide a sealing effect;

a retaining ring adapted to slidably fit within said ring groove, said retaining ring having first and second sides, said second side including a tapered outer portion which slidably engages said tapered second sidewall for locking engagement, a spacer having first and second planar surfaces, said first planar surface abutting said second face of said second member, said second planar surface being in abutment with said first side of said retaining ring, said spacer having an outer circumferential portion projecting into the ring groove so that the edge of said outer circumferential portion terminates at the same depth within the ring groove as the tapered second sidewall, said spacer engaging at its inner end with a ring shaped projection formed in one piece on the second face of said second member;

whereby said O ring, said spacer, and said retaining ring are positioned within said ring groove to provide a simplified construction in which said O ring operates to provide a seal between said first and second members and said retaining ring operates to prevent axial movement of said first and second members relative to each other.

4. The ring and groove construction of claim 3 wherein said axially extending inner surface of said ring groove extends from said first sidewall to said second sidewall.

5. The ring and groove construction of claim 3 or 4 wherein said axially extending inner surface of said ring groove is cylindrical.

6. The ring and groove construction of claim 3 or 4 wherein said axially extending inner surface of said ring groove is frustoconical.

* * * * *